US005704228A

United States Patent [19]

Tranier

[11] Patent Number: 5,704,228

[45] Date of Patent: Jan. 6, 1998

[54] PROCESS AND DEVICE FOR THE EVAPORATION OF A LIQUID FLOW

[75] Inventor: Jean-Pierre Tranier, Villejuif, France

[73] Assignee: L'Air Liquide, Societe Anonyme pour l'Etude et l'Exploitation des Procedes Georges Claude, Paris Cedex, France

[21] Appl. No.: 616,214

[22] Filed: Mar. 15, 1996

[30] Foreign Application Priority Data

Mar. 15, 1995 [FR] France ..... 95 02989

[51] Int. Cl.[6] ..... F25J 3/04

[52] U.S. Cl. ..... 62/643; 62/924; 62/903; 62/905

[58] Field of Search ..... 62/643, 645, 646, 62/924, 903, 905

[56] References Cited

U.S. PATENT DOCUMENTS

| | | | |
|---|---|---|---|
| 4,022,030 | 5/1977 | Brugerolle | 62/630 |
| 4,717,409 | 1/1988 | Atkinson | 62/924 X |
| 4,916,908 | 4/1990 | Lavin et al. | 62/645 |
| 5,291,737 | 3/1994 | Chamberlain et al. | 62/646 |
| 5,454,227 | 10/1995 | Straub et al. | 62/646 |
| 5,551,258 | 9/1996 | Rathbone | 62/646 |

FOREIGN PATENT DOCUMENTS 2.094.088 2/1972 France .

OTHER PUBLICATIONS

J. Borovicka et al., "Cryogenic separation of air", *Chemical Abstracts*, Vol. 107, No. 22, Nov. 30, 1987, p. 179.

*Primary Examiner*—Christopher Kilner
*Attorney, Agent, or Firm*—Young & Thompson

[57] ABSTRACT

In a process for liquid evaporation by heat exchange with a gas which condenses, the pressure of the liquid to be evaporated is reduced and it is enriched in a constituent which has little volatility after evaporation. According to an alternative form, the gas to be condensed can be enriched in the constituent which has little volatility.

19 Claims, 5 Drawing Sheets

PROCESS AND DEVICE FOR THE EVAPORATION OF A LIQUID FLOW

FIELD OF THE INVENTION

The present invention relates to a process and to a device for evaporation of a liquid. More particularly, it applies to a process for evaporation of a liquid which is part of a process for the separation of a gas mixture by cryogenic distillation, such as an air distillation process.

BACKGROUND OF THE INVENTION

It is often necessary to evaporate a liquid flow by latent heat exchange with a gas flow which thus condenses. The invention is concerned with the case where the two flows comprise at least two constituents. If the liquid is richer than the gas flow in the least volatile constituent, the condensation pressure of the gas flow at temperature T will be greater than the evaporation pressure of the liquid flow at (T−ΔT).

For example, if an impure liquid oxygen flow (95% oxygen, 5% nitrogen) is evaporated under a pressure of $5\times10^5$ Pa against an air flow to be condensed, the air pressure of $13\times10^5$ Pa is entirely determined since air has a fixed composition (21% of oxygen and 79% of nitrogen). Air will be regarded here as a binary mixture, in order to make comparisons easier.

In the same way, with an air flow at the same pressure of $13\times10^5$ Pa, a pure nitrogen flow would be evaporated under a pressure of the order of $14\times10^5$ Pa.

In a number of cases, it is desired to reduce the pressure of the gas flow to be condensed or to increase the pressure of the liquid flow to be evaporated but the minimum or maximum pressure is limited by the composition of the flows themselves. For example, in an air distillation process, it is desired to reduce the pressure of the feed air by as much as possible.

SUMMARY OF THE INVENTION

To this end, the subject of the invention is a process for the evaporation of a liquid flow by heat exchange with a gas flow which condenses, the two flows comprising at least two constituents, characterized in that:

i) the liquid flow is enriched in less volatile constituent after its evaporation by heat exchange with the gas flow; and/or ii) the gas flow is enriched in less volatile constituent before its condensation by heat exchange with the liquid flow.

According to other characteristics and advantages of the invention:

the less volatile constituent is oxygen and the other, more volatile, constituent is nitrogen;

the gas and/or evaporated liquid flow(s) is/are enriched in less volatile constituent by conveying it/them into the vessel of a mixing column fed at the head by a liquid which is richer in this less volatile constituent than the mixture to be enriched;

the gas flow condenses in an exchanger situated in the vessel of the mixing column.

Another subject of the invention is a device for the evaporation of a liquid flow by heat exchange with a gas flow, the two flows comprising at least two constituents, comprising means making possible heat exchange between the gas flow and the liquid flow, characterized in that it comprises a means for enriching in less volatile constituent:

i) the evaporated liquid flow downstream of the means making possible heat exchange; and/or ii) the gas flow upstream of the means making possible heat exchange.

According to other characteristics, the means for enriching the flow(s) comprises a mixing column fed by a fluid which is richer in less volatile constituent than the flow to be enriched;

the means making possible heat exchange contain an exchanger situated in the vessel of the mixing column or an exchanger situated in the vessel of a low-pressure column.

It could also be possible to envisage a process for the evaporation of a liquid flow by heat exchange with a gas flow which condenses, the two flows comprising at least two constituents, the liquid flow being richer than the gas flow in less volatile constituent, characterized in that:

i) the liquid flow is enriched in more volatile constituent after its evaporation by heat exchange with the gas flow; and/or ii) the gas flow is enriched in more volatile constituent before its evaporation by heat exchange with the liquid flow.

This makes it possible, under specific conditions, to increase the pressure of the liquid flow to be evaporated.

It could also be possible to design processes and devices which make it possible to modify the content of a number of components of a mixture after the evaporation and/or before the condensation of this mixture. Thus, for a ternary mixture, the mixture could be enriched in the two least volatile constituents.

Another subject of the invention is a device for the evaporation of a liquid flow by heat exchange with a gas flow, the two flows comprising at least two constituents, the liquid flow being richer than the gas flow in less volatile constituent, comprising means making possible heat exchange between the gas flow and the liquid flow, characterized in that it comprises a means for enriching in less volatile constituent:

i) the evaporated liquid flow downstream of the means making possible heat exchange; and/or ii) the gas flow upstream of the means making possible heat exchange.

According to other characteristics of the device:

the means for enriching the flow(s) comprises a mixing column fed by a fluid which is richer in less volatile constituent than the flow to be enriched;

the means making possible heat exchange contain an exchanger situated in the vessel of the mixing column or an exchanger situated in the vessel of a low-pressure column.

A final subject of the invention is a plant for the separation of a gas mixture by distillation containing a device such as described above, in which the liquid flow is a separation product and the gas flow is the gas mixture to be separated.

The invention is particularly useful for cryogenic distillation systems.

BRIEF DESCRIPTION OF THE DRAWINGS

Two implementational examples of the invention will now be described with respect to the appended drawings in which.

DETAILED DESCRIPTION OF THE INVENTION

Figure 1:
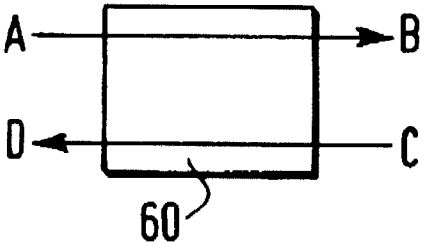
FIG.1 PRIOR ART
FIG. 1 is a diagram of an evaporation device according to the prior art.

FIG. 1 shows a heat exchanger 60 in which a liquid flow A evaporates to form a gas flow B by latent heat exchange with a gas flow C which condenses, forming a liquid flow D. The two flows A and C comprise at least two constituents and C is richer than A in more volatile constituent. For example, A can be impure liquid oxygen (95% $O_2$, 5% $N_2$) and C can be air (79% $N_2$, 21% $O_2$). In this case, if A is at $5\times10^5$ Pa, C must be at $13\times10^5$ Pa.

Figure 2:
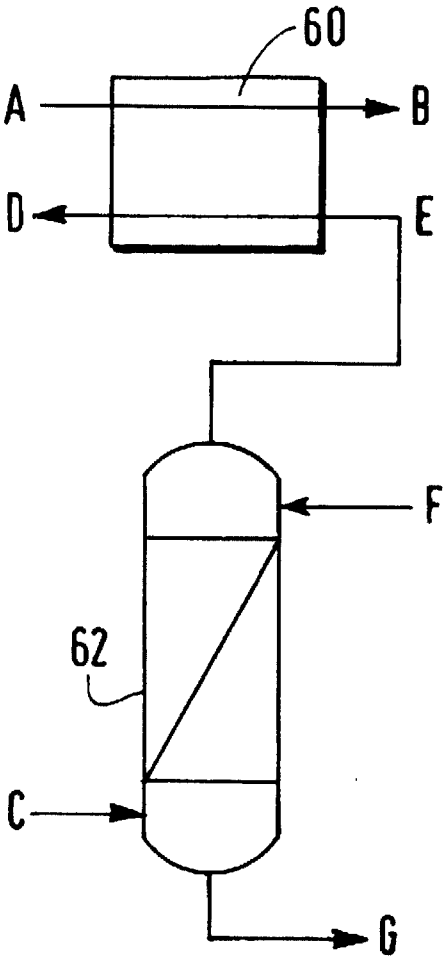

On implementing the invention, in a first process illustrated in FIG. 2, evaporation of an impure liquid oxygen flow A at $5\times10^5$ Pa (95% $O_2$, 5% $N_2$) is continued in the exchanger 60. The composition of the gaseous air flow to be condensed C is modified by conveying it into the vessel of a mixing column 62 fed at the head by a liquid flow F having a composition of 70% $O_2$, 30% $N_2$. A head gas E containing 40% of oxygen is recovered from the column 62 and condenses at a much lower pressure than the air flow C. It is thus possible to reduce the pressure of the gaseous air flow C to $9\times10^5$ Pa.

The invention of FIG. 2 also applies to the case where the evaporation is carried out of a more volatile fluid, such as liquid nitrogen at $14\times10^5$ Pa. Instead of condensing an air flow at $13\times10^5$ Pa in the exchanger 60 of FIG. 1, this air flow is enriched in the mixing column 62 in order to produce, at the head, a gas which is richer in oxygen than air.

Thus, the fluid C which is condensed is enriched in oxygen before its condensation.

Figure 3:
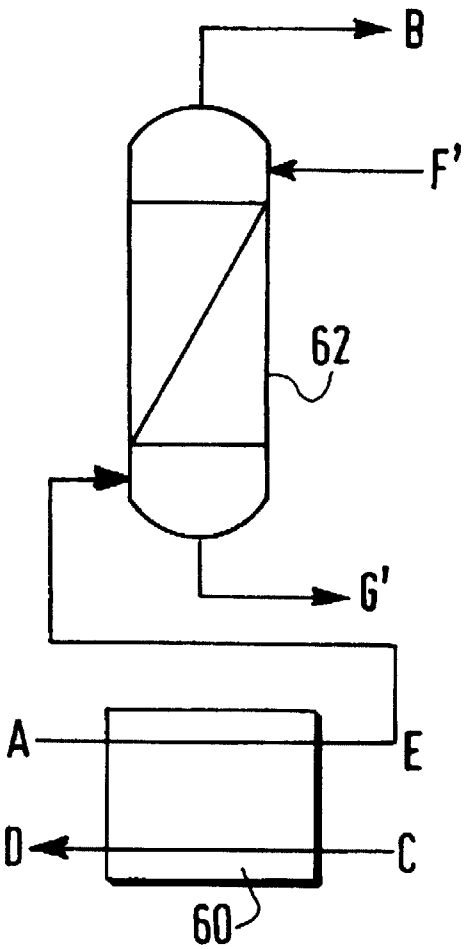
FIGS. 2 and 3 are diagrams of evaporation devices according to a first and a second alternative form of the invention.

On implementing the invention, in a second process illustrated in FIG. 3, it is the composition of the evaporated liquid which is modified. The aim, in this instance, is to produce an impure oxygen gas flow B containing 95% $O_2$ at $5\times10^5$ Pa, a gas flow C which is air at $9\times10^5$ Pa with a composition 21% $O_2$, 79% $N_2$ (air being regarded as a binary mixture) being condensed.

A liquid A, which is poorer in oxygen than the gas flow B which it is desired to produce, is chosen which, at the pressure of $5\times10^5$ Pa, evaporates at the condensation temperature of air at 9 bar. The liquid A has a composition of 70% $O_2$, 30% $N_2$ and evaporates in the exchanger 60. After this evaporation, the fluid E is enriched in oxygen in a mixing column 62, which is also fed by a liquid flow F' having a composition of 98% $O_2$, 2% $N_2$. A gas flow B having the desired composition of 95% $O_2$, 5% $N_2$ is drawn off at the head of the column 62.

Thus, this second process comprises the stage of enriching in oxygen the evaporated fluid after its evaporation, air being condensed at a pressure less than that which would have been necessary to evaporate impure oxygen at the same pressure.

Figure 4:
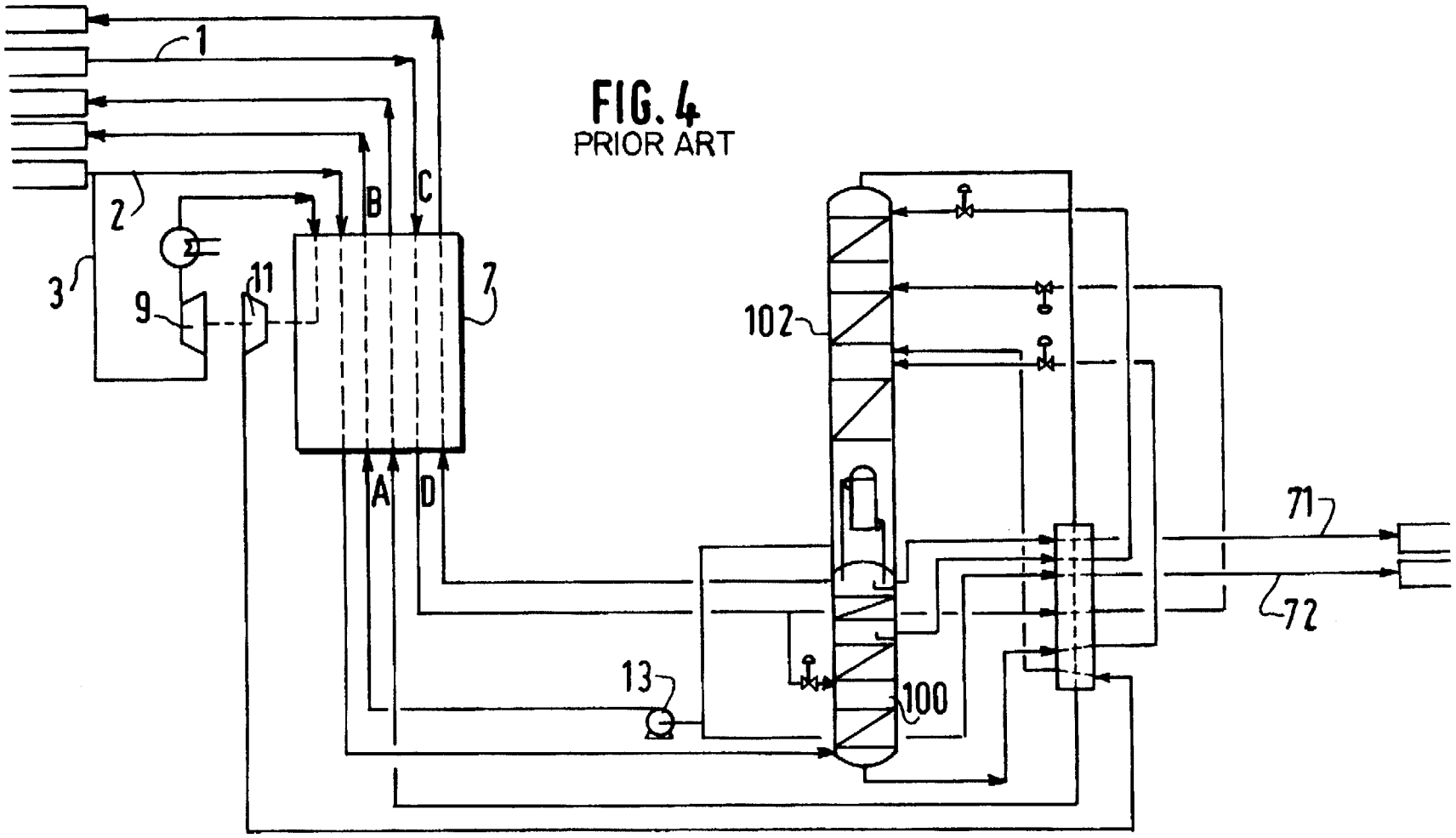
FIG. 4 PRIOR ART
FIGS. 4 and 6 are installation diagrams according to the prior art.

In a conventional pumped liquid oxygen plant, such as that illustrated in FIG. 4, three air flows are conveyed to the main exchanger in which the evaporation of a liquid oxygen flow under pressure takes place. The first flow 1 is at $13\times10^5$ Pa. The remainder of the air (approximately 70%) is compressed to $5\times10^5$ Pa and is divided in two. A second flow 2 passes through the exchanger 7 and is conveyed into the medium-pressure column 100 of a double distillation column. The third flow 3 has its pressure boosted by a pressure booster 9 to $10\times10^5$ Pa, is cooled and has its pressure released via a turbine 11, coupled to the pressure booster, to a pressure slightly above that of the low-pressure column 102, and is then conveyed to the low-pressure column 102 after a subcooling stage.

Only the first flow 1 is liquefied in the exchanger 7 because of its higher pressure; it is divided in two and injected into the low- and medium-pressure columns.

The 95% impure oxygen output is drawn off in the liquid form in the vessel of the low-pressure column 102 and pressurized by the pump 13 to $5\times10^5$ Pa and then evaporated in the exchanger 7.

Figure 5:
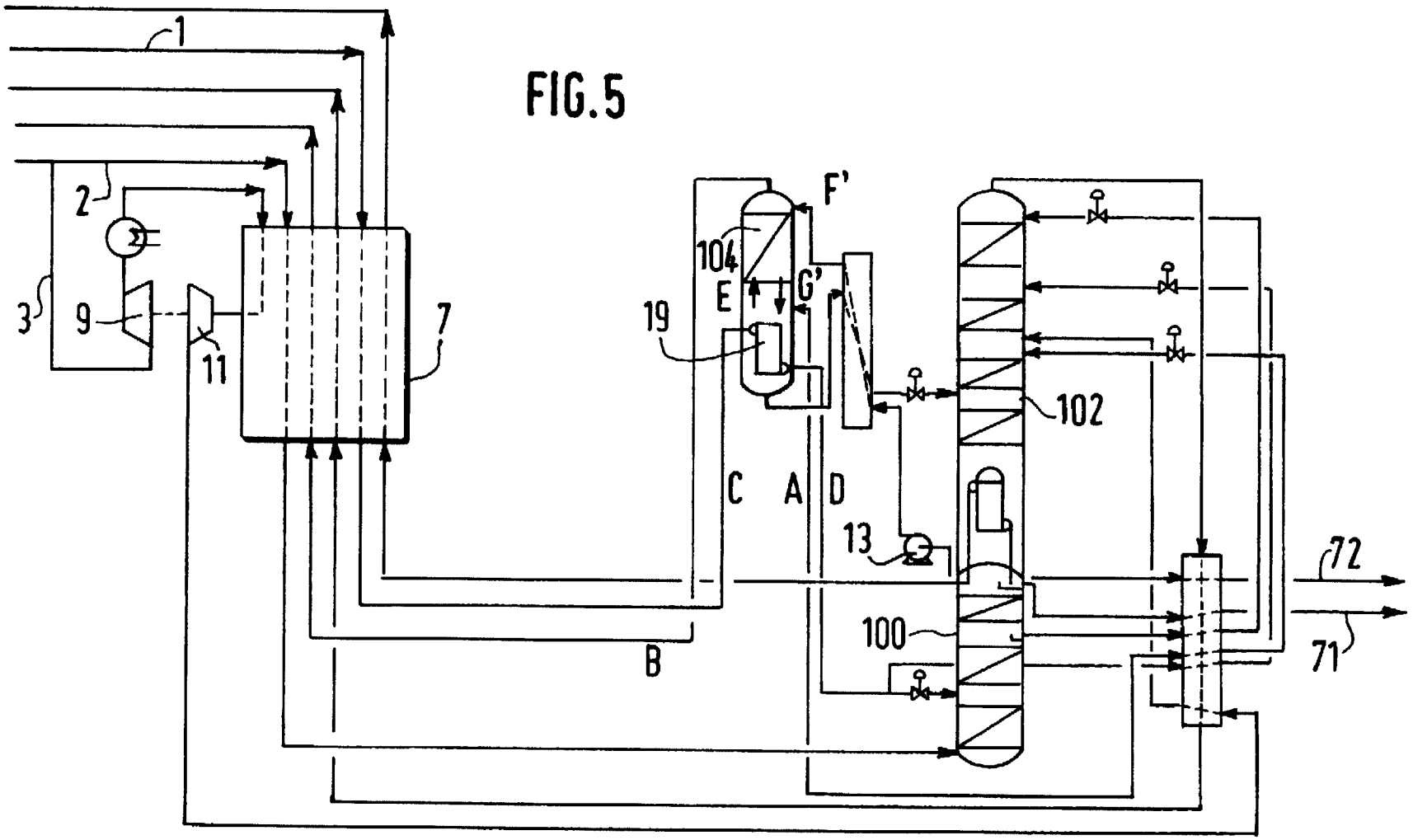
FIG. 5 is a diagram of the integration of the invention, according to the second alternative form of the invention, into the diagram of FIG. 4.

In order to reduce the pressure of the air which evaporates the oxygen, the invention of FIG. 3 is applied to a pumped liquid oxygen plant, such as that illustrated in FIG. 5, where the same components are found as in FIG. 4, with the same numerical references.

The majority of the pressures are identical but the air flow C is only at $9\times10^5$ Pa. The air flow C is no longer condensed on passing through the exchanger 7 but condenses in the vessel condenser 19 of a mixing column 104. Impure liquid oxygen containing 98% of oxygen drawn off in the vessel of the low-pressure column 102 and compressed by the pump 13 is conveyed to the head of the mixing column and the rich liquid flow is conveyed from the vessel of the medium-pressure column 100 into the vessel of the mixing column 104. A gas B with the desired oxygen purity (95%) is drawn off at the head of the mixing column. The liquid to be evaporated in the exchanger 19 is a mixture of rich liquid drawn off from the medium-pressure column 100 and of liquid G' containing 80% of $O_2$ which comes from the vessel tray of the mixing column. A non-evaporated liquid G containing 76% $O_2$, in equilibrium with a vapour E containing 55% $O_2$, is drawn off in the vessel and fed to the column.

Figure 6:
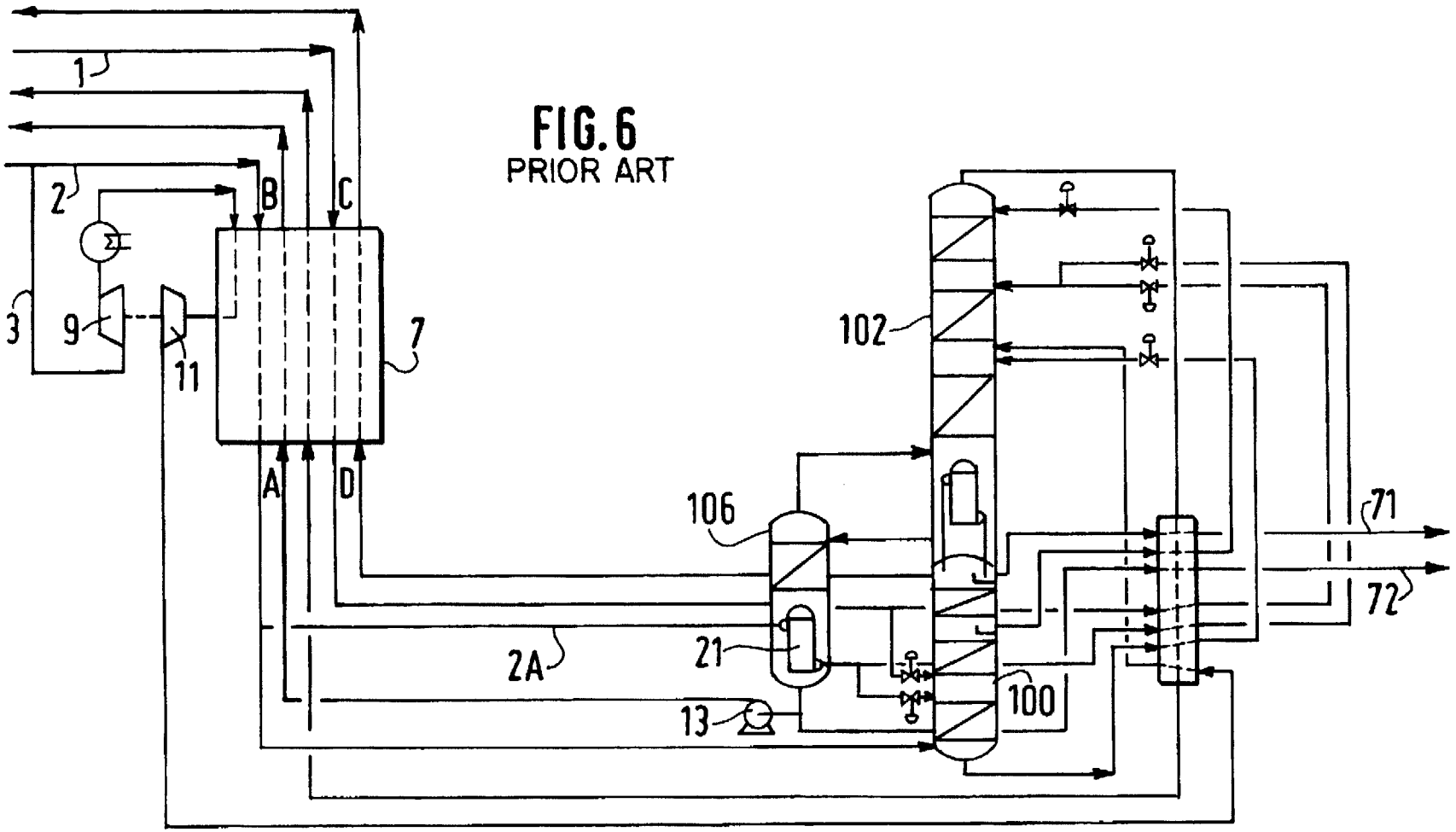
FIG. 6 PRIOR ART

FIG. 6 shows a conventional diagram of a pumped liquid oxygen plant producing oxygen under pressure from distilled air in a double column comprising a medium-pressure column 100 and a low-pressure column 106, 102 comprising two evaporators/condensers; an intermediate evaporator condenses the head nitrogen from the medium-pressure column in order to convey it as reflux into the head of two columns; a vessel evaporator 21 of the lower section 106 of the low-pressure column condenses an air flow by evaporation of liquid oxygen, thus providing the heating in the vessel of this column. The pressure of the medium-pressure column is in this instance defined by the condensation pressure of the air fraction 2A which evaporates the impure oxygen (95% $O_2$) in the evaporator 21.

The liquid oxygen drawn off from the vessel of the low-pressure column is pressurized to $5\times10^5$ Pa in 13 and conveyed to the exchanger where it is evaporated by condensation of an air flow at $13\times10^5$ Pa.

Figure 7:
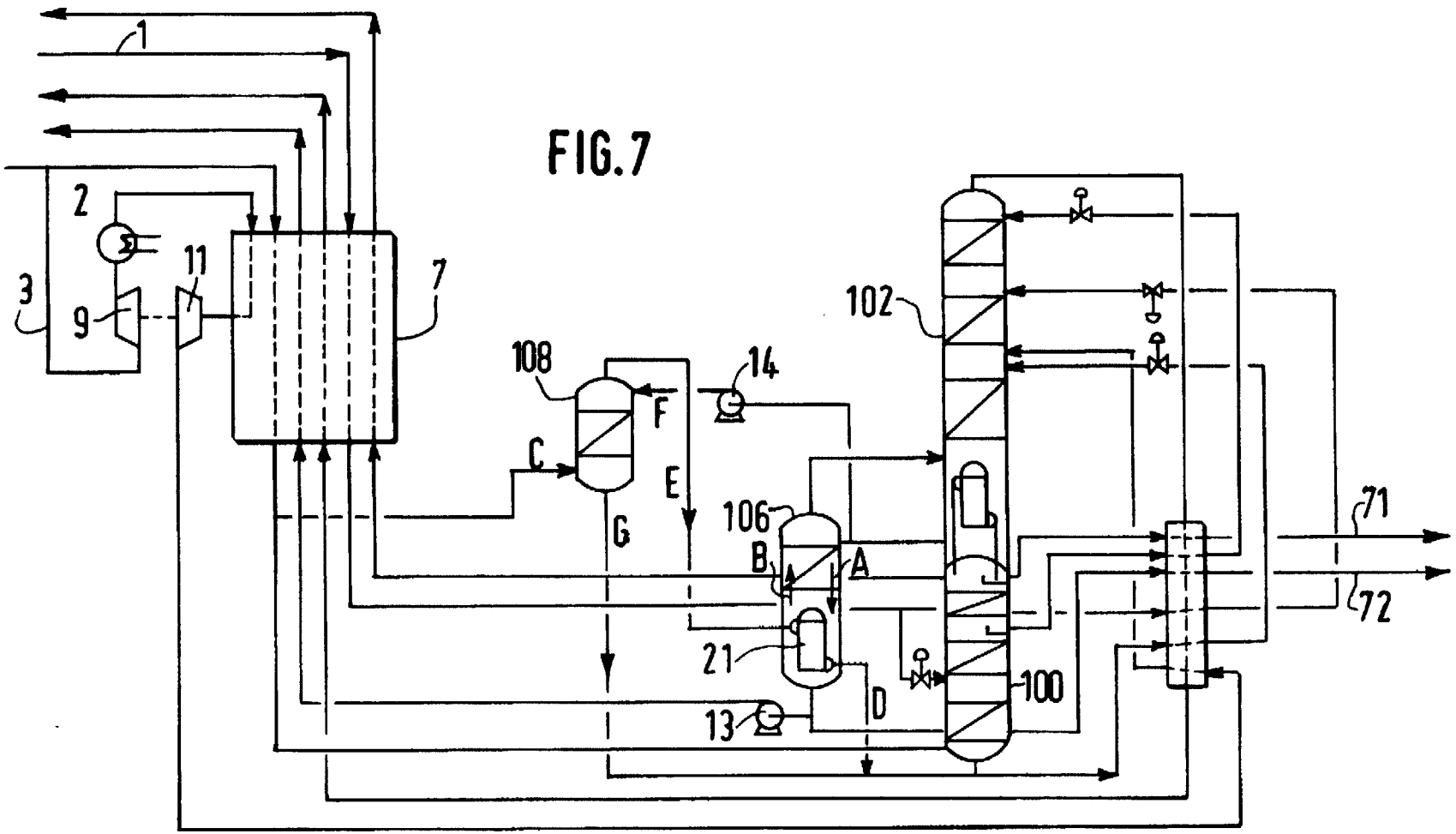
FIG. 7 is a diagram of the integration of the invention, according to the first alternative form of the invention, into the diagram of FIG. 6.

In order to reduce the pressure of the air conveyed to the medium-pressure column, the invention of FIG. 2 is applied to the pumped liquid oxygen plant of FIG. 6. FIG. 7 illustrates this new advantageous arrangement.

The air fraction to be distilled, used in order to provide the heating of the vessel of the low-pressure column and corresponding to the flow C of FIGS. 2 and 7, is conveyed to the vessel of a mixing column 108 where it is brought into contact with an oxygen-rich liquid F, pressurized at 14, originating from an intermediate level of the low-pressure column. On contact with this liquid, the air is enriched in oxygen and a flow E with a composition 40% $O_2$, 60% $N_2$ is drawn off from the column 108 and condenses in the vessel evaporator 21 of the low-pressure column. The vessel liquid G from the mixing column, with an oxygen concentration of 40%, is mixed with the liquid D and with the rich liquid drawn off in the vessel of the medium-pressure column 100. These liquids are used as reflux for the low-pressure column 102.

This arrangement makes possible a reduction in the air pressure of approximately 20%, resulting in an energy saving with respect to the main air compressor.

The invention does not apply solely to the case where a liquid binary mixture evaporates by heat exchange with a gaseous binary mixture which condenses. The use of the invention for evaporating a liquid containing only one constituent against a gas mixture containing this constituent as well as a lesser amount of another gas which is more volatile than the common constituent could easily be envisaged.

The invention also applies to other gases and other liquids.

The invention also applies to the cases where the fluids B (FIG. 2) and E (FIG. 3) are partially evaporated and the fluids D (FIGS. 2 and 3) are partially condensed.

I claim:

1. Process for the evaporation of a liquid flow by heat exchange with a gas flow which condenses, each of the two flows comprising at least two constituents, the process comprising:

evaporating the liquid flow by heat exchange with the gas flow so as to obtain an evaporated liquid mixture;

enriching the evaporated liquid mixture in less volatile constituent by conveying it into a mixing column, and by exchange of heat with the gas flow.

2. Process according to claim 1, wherein the gas flow is enriched in less volatile constituent before condensation by heat exchange with the liquid flow.

3. Process according to claim 1, wherein the less volatile constituent is oxygen and another, more volatile constituent is nitrogen.

4. Process according to claim 1, wherein the evaporated liquid mixture is enriched in less volatile constituent by conveying it into a vessel of a mixing column, said mixing column having a head which is fed by a liquid which is richer in less volatile constituent than the evaporated liquid mixture to be enriched.

5. Process according to claim 4, wherein impure oxygen is produced, an oxygen-rich liquid fraction is evaporated to produce an evaporated liquid fraction which is conveyed into the mixing column where the evaporated liquid fraction and a liquid oxygen flow drawn off from a vessel of a low-pressure column of a double column, with a purity slightly greater than the impure oxygen in vapor form, are brought in contact, for exchange of heat and of material, and impure oxygen is drawn off at the head of the mixing column.

6. Process according to claim 5, wherein liquid drawn off from the vessel of the mixing column is conveyed into the low-pressure column.

7. Device for the evaporation of a liquid flow by heat exchange with a gas flow, each of the two flows comprising at least two constituents, the device comprising:

evaporating means for exchanging heat between the gas flow and the liquid flow so as to obtain an evaporated liquid mixture, mixing column means, positioned downstream of the evaporating means, for enriching in less volatile constituent the evaporated liquid mixture.

8. Device according to claim 7, further comprising means for enriching in less volatile constituent the gas flow upstream of the evaporating means.

9. Device according to claim 8, wherein the mixing column means are fed by a fluid which is richer in less volatile constituent than the evaporated liquid mixture to be enriched.

10. Device according to claim 9, wherein the evaporating means comprise an exchanger situated in a vessel of the mixing column.

11. Process for the evaporation of a liquid flow heat exchange with a gas flow which condenses, each of the two flows comprising at least two constituents, the process comprising:

enriching the gas flow in less volatile constituent before condensing the gas flow by heat exchange with the liquid flow so as to obtain a gaseous fluid enriched in less volatile constituent, the less volatile constituent being oxygen and the other, more volatile constituent being nitrogen, the gas flow being enriched in less volatile constituent by conveying the gas flow into the bottom of a mixing column fed at the head by a liquid which is richer in less volatile constituent than the gas flow to be enriched, wherein the gaseous fluid enriched in less volatile constituent condenses in a vessel evaporator of a low-pressure column of a medium-pressure/low-pressure double column, said low-pressure column containing an intermediate evaporator which condenses the head nitrogen of the medium-pressure column, said oxygen being evaporated by heat exchange with a vapor, is richer in oxygen than air, drawn off from the head of a mixing column where a fraction of the air to be distilled and the liquid fraction which is richer in oxygen originating from an intermediate level of the low-pressure column are brought into contact for exchange of heat and material; and conveying liquid produced in the vessel of the mixing column and the condensed vapor into the low-pressure column.

12. Process according to claim 11, wherein the liquid fraction is part of the rich liquid originating from the medium-pressure column.

13. Process according to claim 12, wherein the liquid fraction is a mixture of rich liquid and of liquid drawn off from a vessel tray of the mixing column.

14. Device for the evaporation of a liquid flow by heat exchange with a gas flow, each of the two flows comprising at least two constituents, the device comprising:

evaporator means for exchanging heat between the gas flow and the liquid flow so as to obtain an evaporated liquid mixture, and mixing column means, positioned downstream of evaporator means, for enriching in less volatile constituent the evaporated liquid mixture, said evaporator means comprising an exchanger situated at the bottom of a low-pressure column.

15. Device according to claim 14, further comprising means for enriching in less volatile constituent the gas flow upstream of the evaporator means.

16. Device according to claim 14, wherein the mixing column means are fed by a fluid which is richer in volatile constituent than the evaporated liquid mixture.

17. Plant for the separation of a gas mixture by distillation containing a device according to claim 7, wherein the liquid flow is a separation product and the gas flow is the gas mixture to be separated.

18. Plant according to claim 17, wherein the liquid flow is a pressurized flow of at least one constituent of air and the gas flow is air.

19. Plant for the separation of a gas mixture by distillation containing a device according to claim 14, wherein the liquid flow is a separation product and the gas flow is the gas mixture to be separated.

* * * * *